United States Patent [19]

Shaffer

[11] Patent Number: 5,027,756

[45] Date of Patent: Jul. 2, 1991

[54] NUTATING SPIDER CRANK RECIPROCATING PISTON MACHINE

[75] Inventor: James E. Shaffer, Maitland, Fla.

[73] Assignee: Consulier Industries, Inc., Riviera Beach, Fla.

[21] Appl. No.: 485,236

[22] Filed: Feb. 23, 1990

[51] Int. Cl.[5] ..... F02B 75/26

[52] U.S. Cl. ..... 123/58 R; 123/197 R

[58] Field of Search ..... 123/197 AC, 58 R, 58 B, 123/58 C, 197 R

[56] References Cited

U.S. PATENT DOCUMENTS

| | | | |
|---|---|---|---|
| 1,808,380 | 6/1931 | Royal . | |
| 2,532,106 | 11/1950 | Korsgren | 123/51 A |
| 3,007,462 | 11/1961 | Balzer | 123/58 |
| 3,212,483 | 10/1965 | Balzer | 123/41.84 |
| 3,528,317 | 9/1970 | Cummins | 74/598 |
| 3,555,814 | 11/1968 | Morsell | 123/58 R |
| 4,144,771 | 3/1979 | Kemper et al. | 123/78 E |
| 4,152,944 | 5/1979 | Kemper | 123/58 BA |
| 4,185,508 | 1/1980 | Hardt | 123/58 R |
| 4,203,396 | 5/1980 | Berger | 123/58 BB |
| 4,433,596 | 2/1984 | Scalzo | 123/58 B |
| 4,489,682 | 12/1984 | Kenny | 123/58 |
| 4,515,113 | 5/1985 | DeLorean | 123/58 B |

FOREIGN PATENT DOCUMENTS

| | | | |
|---|---|---|---|
| 724356 | 7/1942 | Fed. Rep. of Germany | 123/58 R |

*Primary Examiner*—David A. Okonsky

*Attorney, Agent, or Firm*—Warren L. Franz

[57] ABSTRACT

A reciprocating piston machine in the form of a barrel engine has angularly-spaced pistons directly centrally linked by wrist pins to radially extending branches of a spider obliquely journalled for nonrotational nutation on a Z-crank portion of a rotational shaft. The pistons are double-acting pistons providing two piston surfaces per cylinder in rodless connections to a single spider.

9 Claims, 2 Drawing Sheets

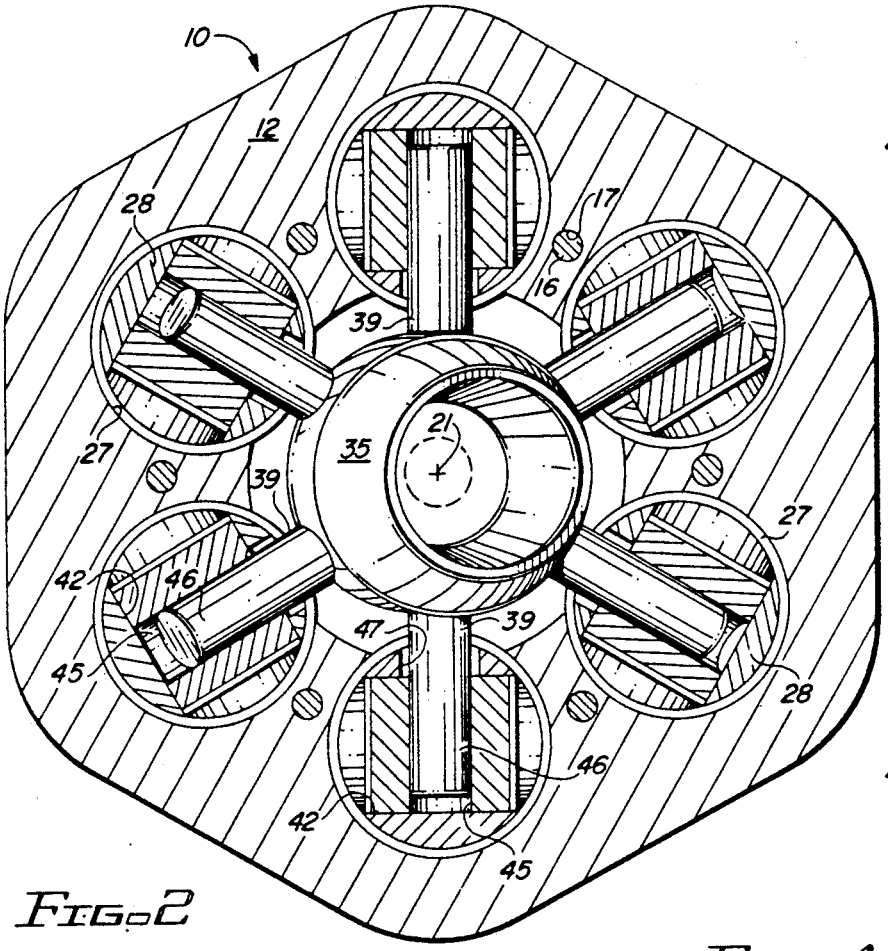
FIG. 2
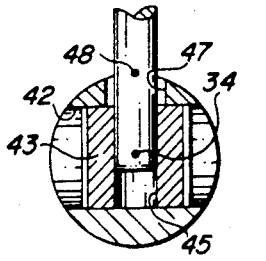
FIG. 6A
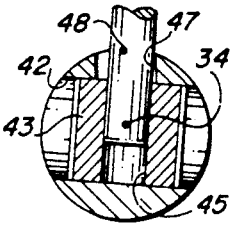
FIG. 6B
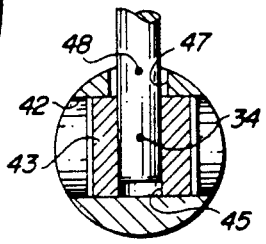
FIG. 6C
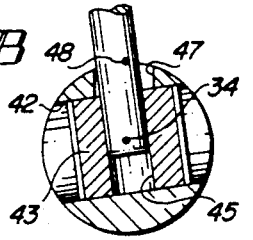
FIG. 6D
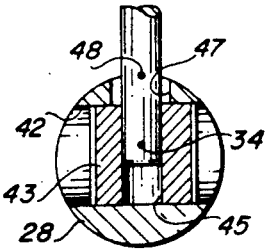
FIG. 6E
FIG. 4A
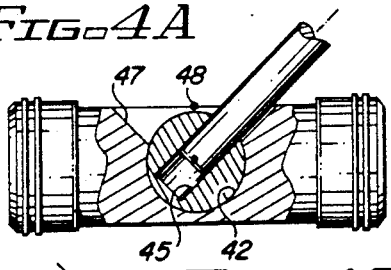
FIG. 4B
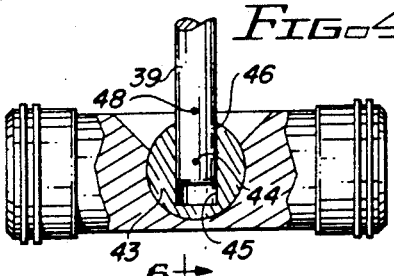
FIG. 4C
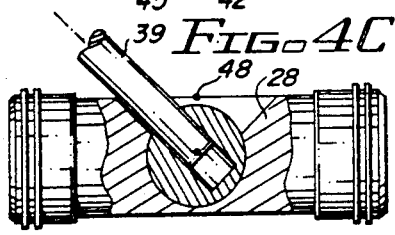
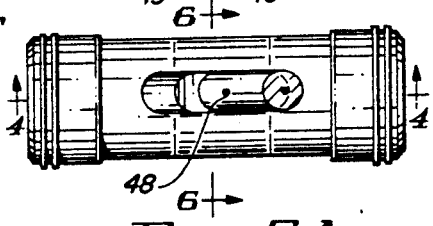
FIG. 5A
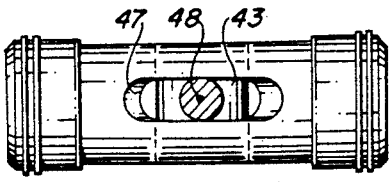
FIG. 5B
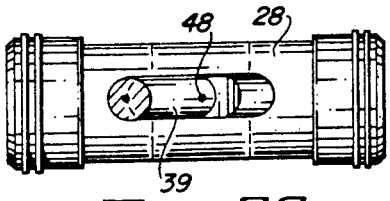
FIG. 5C

NUTATING SPIDER CRANK RECIPROCATING PISTON MACHINE

This application relates, in general, to machines for transferring motion between a reciprocating piston and a rotating shaft by means of a nutating spider obliquely located on the crank shaft; and, in particular, to a machine of the reciprocating piston barrel type employing improved means for linking the piston to the spider.

BACKGROUND OF THE INVENTION

Reciprocating piston machines of the type to which the present invention relates typically include a central shaft journalled in a block and a plurality of cylinders disposed parallel to the shaft and located on the block at angularly-spaced intervals circumferentially about the shaft. The shaft includes an oblique or Z-crank portion on which is journalled a nutating spider or "wobble plate." The spider has radially extending branches linked at swivel joints by means of rods to reciprocating pistons located in the cylinders.

The machines may be used as compressors, in which case the shaft is driven; or may be used as power generators or engines, in which case a fluid under pressure is injected or formed within the cylinders to drive the pistons. When the machine is constructed as an internal combustion engine, the fluid takes the form of gasoline, diesel fuel or other combustible fluid which is exploded at the end of a compression stroke to cause the pistons to be driven. The thrust of the driven pistons is imparted to the spider by means of the rods while spider rotation is restrained, thereby causing nonrotational nutation of the spider which is translated into rotation of the shaft. A common arrangement has two pistons in each cylinder, with oppositely directed rods that join separate spiders which cooperate in synchronization to drive the shaft.

Examples of known nutating spider crank reciprocating piston machines are given in U.S. Pat. Nos. 1,808,380; 3,007,462; 3,212,483; 3,528,317; and 4,489,682. All such arrangements have separate, opposing single-acting pistons with oppositely directed rods that reach into distal ends of the pistons to link the pistons to terminal ends of the radial branches of separate spiders. Two (typically ball and socket) swivel connections are used, one at the junctures of the pistons with the rods, and one at the junctures of the rods with the spiders. Means, such as a spline or guide rail arrangements, are required to absorb the rotational torque and restrain the spider from rotating with the shaft. Such machines are often referred to as "barrel" engines because of their revolver barrel-like appearance.

SUMMARY OF THE INVENTION

It is an object of the present invention to provide a nutating spider crank reciprocating piston machine wherein linkage between the pistons and the branches of the spider is accomplished directly at a single swivel connection, without the need for rods.

It is a further object of the invention to provide a nutating spider crank reciprocating piston machine of the two-piston-per-cylinder type utilizing single double-acting pistons in each cylinder and only one spider.

In accordance with the invention, a reciprocating machine of the barrel type has a central shaft journalled on a block or housing and a plurality of cylinders angularly-spaced circumferentially about the shaft. A nutating spider has a hub portion mounted obliquely on the shaft and a plurality of radially extending branches connected by means of swivel connections directly to pistons mounted for reciprocation within corresponding ones of the cylinders. A preferred embodiment, described in greater detail below, has wrist pin means connecting the terminal ends of the branches to central portions of double-acting cylinders, so that two-piston-per-cylinder type operation is achieved utilizing a single spider piston-shaft connection.

BRIEF DESCRIPTION OF THE DRAWINGS

Embodiments of the invention have been chosen for purposes of description and illustration, and are shown in the accompanying drawings, wherein:

FIG. 2 is a front vertical section view of the machine of FIG. 1, with the spider rotated relative to its position in FIG. 1;

FIGS. 4A–C, 5A–C and 6A–E are schematic views helpful in understanding relative positions of the components assumed during an operating cycle.

Throughout the drawings, like elements are referred to by like numerals.

DETAILED DESCRIPTION OF THE PREFERRED EMBODIMENTS

The principles of the invention are illustrated, by way of example, embodied in the form of a nutating spider crank displacement engine 10 of the barrel type.

Figure 1:
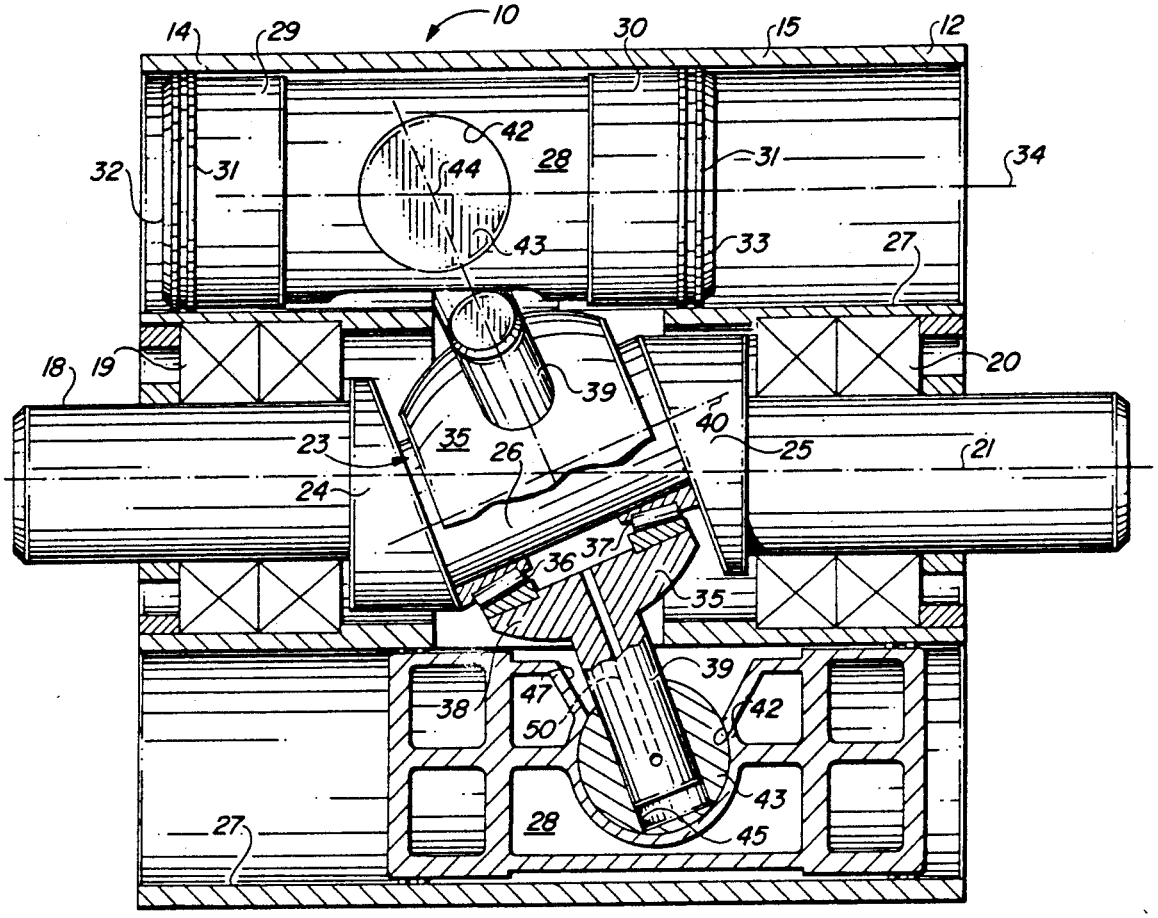
FIG. 1 is a side vertical section view of a reciprocating piston machine embodying the principles of the invention.

With reference to FIGS. 1 and 2, the machine 10 has a block housing 12 comprising left and right block halves 14, 15 joined by suitable means such as bolts 16 extending through axially parallel bores 17. A shaft 18 is journalled by suitable means, such as bearings 19, 20, on block 12 to extend through the center of the block 12 for rotation therein about a shaft axis 21. Shaft 18 includes an oblique or Z-crank portion 23 (omitted for clarity in FIG. 2) which may be formed integrally with the shaft 18 or as a multi-component assembly including left and right tilted crank halves 24, 25 joined by an angled crank stud 26 having oppositely threaded ends threadingly interengaging and joining the halves 24, 25.

Engine block 12 has a plurality of cylinders 27 disposed parallel to shaft axis 21 and spaced equidistantly at angularly-spaced intervals in a symmetrical arrangement about shaft 18. The arrangement shown (see FIG. 2) has six cylinders spaced at 60° intervals about the shaft 18. A plurality of pistons 28 are likewise disposed parallel to the shaft axis 21, respectively mounted for reciprocation coaxially within corresponding ones of the cylinders 27. Each piston 28 is a double-acting piston having oppositely facing, left and right cylinder heads 29, 30 suitably provided with sealing rings 31 to present two planar hydraulic piston surfaces 32, 33 normal to the coincident piston and cylinder axes 34.

A nutating spider 35 is journalled on the Z-crank portion 23 obliquely of the shaft axis 21, such as by means of tapered roller bearings 36, 37 which mount a truncated spherical hub portion 38 coaxially annularly of the crank stud 26. The spider 35 also includes a plurality of branches 39 extending radially outward from hub portion 38 at right angles to the crank stud axis 40. The branches 39 take the form of cylindrical posts.

Figure 3:
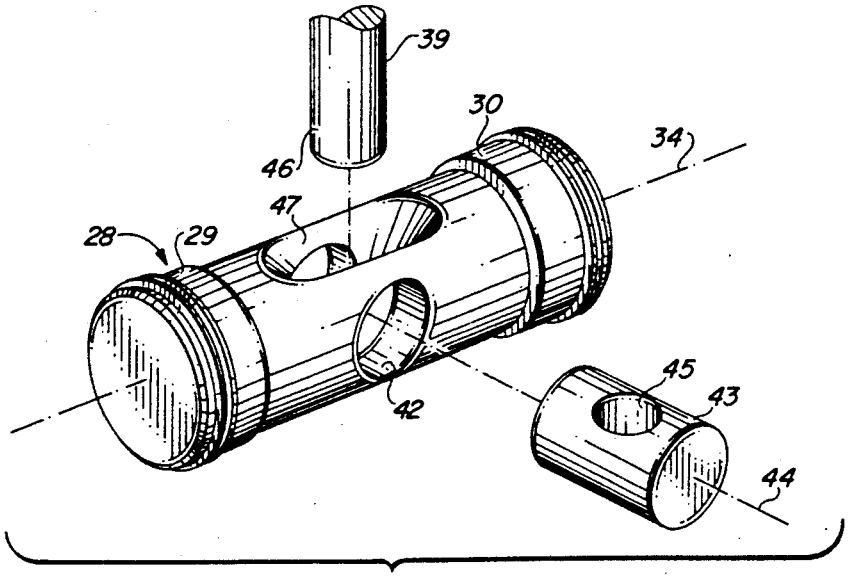
FIG. 3 is an exploded, perspective view showing details of the connection between the pistons and the spider in the machine of FIGS. 1 and 2.

In accordance with the invention, means are provided connecting terminal ends of the branches 39 directly at central interior regions of the pistons 28. The direct connection of the branches 39 to the pistons 28 is illustrated in the exploded view of FIG. 3.

Each piston 28 includes a transverse bore 42 into which a cylindrical wrist pin 43 is coaxially received for free rotation therein about a pin pivotal axis 44 at right angles to the piston axis 34. The pin 43 itself includes a transverse bore 45 directed at right angles to the pin axis 44 and into which a terminal end 46 of a respective branch 39 extends for free movement axially of the bore 45. An elongated slot 47 formed in axial alignment with the piston axis 34 provides access by the branch 39 into the bore 42. The slot 47 is of high aspect ratio, elliptical cone shape, to accommodate motion of the branch 39 relative to the piston 28, as described further below. The slot 47 opens onto the outer cylindrical surface of the piston 28 at a point circumferentially 90 degrees removed from the locations at which the piston transverse bore 42 opens onto the same surface.

The pistons 28 of the shown engine 10 are double-acting pistons with two oppositely-facing piston surfaces 32, 33 that can each act hydraulically within the cylinders 27. A single piston element 28 can thus serve a double function similar to that of two single-acting pistons per cylinder in conventional arrangements, such as those shown in the U.S. patents referenced above. The cycling will, however, be coordinated so that for each cylinder one piston head is moving in an expansion stroke, while the other is moving in a compression stroke, rather than both moving in expansion or both moving in compression strokes.

This mounting of double-acting pistons 28 is facilitated by the central, direct piston-to-branch mounting feature of the invention and offers a capability not available with conventional rod-into-piston-end mountings. The engine 10 may, if desired, be constructed with two single-acting pistons per cylinder in which case separate identical spider cranks 35 of opposite angular orientation are provided at opposite ends of the same shaft 18.

In operation, as the pistons 28 reciprocate in their respective cylinders 27, thrust is applied directly to the branches 39 from the pistons 28 through the wrist pins 43 of the spider 35. Rotation of the spider 35 is restrained by the confinement of the pistons 28 within the cylinders 27 because of the extension of the branch ends 46 through the slots 47 (FIG. 3) and into the pin bores 43. The spider 35 will nutate under cyclic application of thrust by the phased pistons 28 to the branches 39, thereby imparting rotation to the crank stud 26 and, thus, to the shaft 18. Rotation is taken from the shaft 18 as useful power. In an internal combustion engine application, combustible fuel intake and exhaust discharge ports (not shown) will be formed and located as appropriate. So, too, passages (see 50 in FIG. 1) will be employed to provide channels for lubrication.

As with prior art similar mechanisms, the spider 35 does not rotate in the operation of machine 10; it merely nutates around as the crank stud 26 rotates. There is, however, significant rotational torque produced on the spider 35 that must be resisted, or it will drive the spider 35 around. The prior art machines described in the referenced patents require separate mechanisms to prevent rotation of the spider, while permitting the necessary nutation. Moreover, the torque is absorbed through the intermediaries of rods. In accordance with the invention, however, the direct connection between the spider 35 and the pistons 28 itself restrains the rotation of the spider 35 and absorbs the torque, without the need for rods.

The relative motion between the pistons 28, wrist pins 43 and branch ends 46 in FIGS. 1 and 2 can be seen with reference to the schematic views at various cycle phases shown in FIGS. 4–6. As each piston 28 reciprocates, it moves between a leftmost position (shown by the upper piston 28 in FIG. 1) and a rightmost position (shown by the lower piston 28 in FIG. 1). When viewed in a plane passing through piston axis 34 and shaft axis 21 (see FIGS. 4A–C), the center point of the piston 28 (coincident with the axis 44 in FIGS. 4A–C) oscillates between a leftmost position and a rightmost position, along a straight path coincident with the axis 34 of the cylinder 27. The end 46 of the branch 39 meanwhile follows an arcuate path in the same plane, the branch 39 moving axially within the bore 45 of the pin 43, cycling from a maximum withdrawal position (FIG. 4A) with the branch outside diameter adjacent the right portion of slot 47, through a maximum insertion position (FIG. 4B) with the branch centered in slot 47, to an opposite maximum withdrawal position (FIG. 4C) with the branch outside diameter adjacent the left portion of slot 47. This motion is accommodated by the freedom of pivotal movement of the wrist pin about its axis 44 within the piston bore 42, and the freedom of axial movement of the branch end 46 within the wrist pin bore 45.

The changes in angling of the branches 39 relative to the shaft axis 21 as the spider 35 nutates are accommodated by lateral movement of the wrist pins 43 back and forth axially within the piston bores 42, and slight pivotal (i.e. helical or honing-like) motion of the piston 28 as it reciprocates within the cylinder 27. This can be seen in FIGS. 5A–C and 6A–C which show relative positions of the elements as viewed in different planes, corresponding to the same cycle phase positions (and intermediate positions for FIGS. 6B and D) as the positions of FIGS. 4A–C. Viewed in a horizontal plane, a central point 48 (FIG. 5B) of the opening of slot 47 on the outside surface of piston 28 will undergo a slight figure eight-like motion.

FIG. 2 shows the spider 35 nutated relative to its position in FIG. 1, with pistons at the two, four, eight and ten o'clock positions shown rotated slightly at intermediate points of their respective cycles (see varying relative positions of the branch ends 46 laterally of the slots 47). The slots 47, pins 43 and bores 42 are relatively dimensioned, configured and adapted to accommodate such figure eight motion; the pins 43 being formed to shift laterally, but without interfering with the internal walls of the cylinders 27.

The linkage arrangement of machine 10, with a single, direct swivel point connection between the branch ends 46 and the pistons 28, offers advantageous transmission of forces between reciprocation of the pistons 28, and rotation of the shaft 18. The coupling is less complex than the rod couplings used in conventional barrel reciprocating piston machines and uses the confinement of the pistons 28 themselves, rather than a separate mechanism, to restrain the spider 35 against rotation and to absorb the rotational torque. Connecting branches 39 directly to central locations on pistons 28 enables the use of double-acting pistons to provide two simultaneously acting piston surfaces 32, 33 per cylinder 27, without the need to synchronize separate, oppositely angled spiders.

It will, of course, be appreciated that the six cylinder arrangement shown is merely for purposes of illustration and description and that other arrangements of a different number of cylinders, pistons and branches may be utilized. As already mentioned, it will also be apparent that the principles may be applied to compressors or pumps, as well as to engines or motors. Those skilled in the art to which the invention relates will appreciate that other substitutions and modifications can also be made to the described embodiment without departing from the spirit and scope of the invention as described by the claims below.

What is claimed is:

1. Reciprocating piston apparatus, comprising:

a housing;

a shaft journalled on said housing for rotation about a shaft axis;

a plurality of cylinders each having a central longitudinal axis and disposed parallel to said shaft axis and located on said housing at positions angularly-spaced circumferentially about said shaft;

a plurality of double-acting pistons having piston axes and centers, each said piston having a transverse bore therein and being respectively mounted for reciprocation within corresponding ones of said cylinders, each said bore having a longitudinal central axis normal to the respective cylinder axis;

a nutating spider having a central hub portion mounted on said shaft obliquely of said shaft axis, and having a plurality of branches extending radially outward from said hub portion and terminating at terminal ends; and means directly connecting said terminal ends centrally to corresponding ones of said bores for transferring motion between reciprocation of said pistons and rotation of said shaft, and for restraining said spider from rotating with said shaft; said means directly connecting said terminal ends permitting pivoting of said pistons about transverse axes running through said centers at right angles to said piston axes, and permitting movement of said centers both radially of said hub and axially of said transverse axes relative to said terminal ends.

2. Apparatus as in claim 1, wherein said means directly connecting said terminal ends further comprises pins having pin axes and being respectively coaxially received for free rotation within said piston transverse bores and for free movement axially of said transverse bores.

3. Apparatus as in claim 2, wherein each pin includes a transverse bore directed at right angles to its pin axis, and wherein said means directly connecting said terminal ends further comprises said terminal ends being respectively received within said pin transverse bores for free movement axially of said pin transverse bores.

4. Apparatus as in claim 3, wherein each piston further includes an outside surface an elongated slot formed in axial alignment with the piston axis, said slot being of high aspect ratio, elliptical cone shape and opening from said outside surface into said piston transverse bore.

5. Apparatus as in claim 4, wherein said piston transverse bore has diametrically-opposite openings onto said surface, and wherein said slot opens at said surface at a point circumferentially 90 degrees removed from the openings of said piston transverse bore.

6. In a barrel-type reciprocating piston machine which includes a block; a shaft journalled on said block for rotation about a shaft axis; a plurality of cylinders disposed parallel to said shaft axis and located on said housing at positions angularly-spaced circumferentially about said shaft; a plurality of pistons mounted for reciprocation within corresponding ones of said cylinders each said piston having a transverse bore therein; a spider journalled obliquely on said shaft and having a plurality of branches extending outwardly therefrom; means restraining said spider from rotating with said shaft; and means linking said outwardly extending branches to corresponding ones of said pistons for transferring thrust from reciprocation of said pistons, by nutation of said spider, into rotation of said shaft; the improvement comprising said branches being respectively connected directly to said piston transverse bores via wrist pins, said wrist pins having pin axes and transverse bore directed at right angles to said pin axes; said pins being coaxially received for free rotation within said piston transverse bores and for free movement axially of said piston transverse bores; and said branches having ends received into said pin transverse bores for free movement axially of said pin bores.

7. An improvement as in claim 6, further comprising said pistons being double-acting pistons with piston axes and centers, and having two oppositely-disposed piston surfaces; said branches being connected to said pistons at locations centrally between said piston surfaces; and said swivel connections permitting pivoting of said pistons about said piston axes, pivoting of said pistons about transverse axes running through said centers at right angles to said piston axes, and movement of said centers along the direction of outward extension of said branches relative to said branches.

8. In a barrel-type reciprocating piston machine which includes a block; a shaft journalled on said block for rotation about a shaft axis; a plurality of cylinders disposed parallel to said shaft axis and located on said housing at positions angularly-spaced circumferentially about said shaft; a plurality of pistons mounted for reciprocation within corresponding ones of said cylinders; a spider journalled obliquely on said shaft and having a plurality of branches extending outwardly therefrom; means restraining said spider from rotating with said shaft; and means linking said outwardly extending branches to corresponding ones of said pistons for transferring thrust from reciprocation of said pistons, by nutation of said spider, into rotation of said shaft; the improvement comprising said pistons having piston axes, transverse bores directed at right angles to said piston axes, elongated elliptical cone shaped slots axially aligned with said piston axes and opening into said piston transverse bores; said linking means comprising wrist pins having pin axes and transverse bores directed at right angles to said pin axes; said pins being coaxially received for free rotation within said piston transverse bores and for free movement axially of said piston transverse bores; and said branches having ends received through said slots into said pin bores for free movement axially of said pin bores.

9. An improvement as in claim 8, further comprising said pistons being double-acting pistons having two oppositely-disposed piston surfaces, and said piston bores being located centrally between said piston surfaces.

* * * * *